United States Patent [19]

Li

[11] Patent Number: 4,988,109

[45] Date of Patent: Jan. 29, 1991

[54] QUICK-SET DOMINO ARRANGEMENTS INCLUDING TWO-PERSON DOMINO CHALLENGE GAME

[76] Inventor: Shuo-Yen R. Li, 820 Long Hill Rd., Gillette, N.J. 07933

[21] Appl. No.: 296,001

[22] Filed: Jan. 12, 1989

[51] Int. Cl.[5] ..... A63F 7/02

[52] U.S. Cl. ..... 273/281

[58] Field of Search ..... 273/55 A, 86 R, 261, 273/281, 294, 275; 446/2

[56] References Cited

U.S. PATENT DOCUMENTS

| | | | |
|---|---|---|---|
| 3,002,491 | 10/1961 | Bachman | 273/281 |
| 3,315,404 | 4/1967 | Rosen | 273/86 R |
| 3,621,601 | 11/1971 | Greenburg et al. | 446/2 |
| 3,840,237 | 10/1974 | Shkolnik | 273/261 |
| 3,851,883 | 12/1974 | Hitchcock et al. | 273/261 |
| 3,917,273 | 11/1975 | Blakewood | 273/261 |
| 4,248,433 | 2/1982 | Soriano | 446/2 |
| 4,438,586 | 3/1984 | Wildman et al. | 446/2 |
| 4,632,664 | 12/1986 | Manning | 446/2 |
| 4,740,185 | 4/1988 | Inglee | 446/2 |
| 4,761,010 | 8/1988 | Brotz | 273/275 |

*Primary Examiner*—William H. Grieb

*Attorney, Agent, or Firm*—Peter L. Michaelson

[57] ABSTRACT

Domino boards exploit an array of dominoes rotatably mounted to the top surface of each of the boards so that the array may be quickly reset by a single manipulation of the board by a user. A plurality of board shapes may be linked into modules and each module may also be reset by a single manipulative action. A plurality of modules are combined to form a game configuration.

A game of challenge is introduced by mounting dominoes at strategic locations on a specially designed board. An identifier such as color is associated with each of the dominoes on the board and a mathematical algorithm founded in "game theory" is deployed to generate a location for each domino based on its identifier. According to one set of game rules, there are two players, each player controls a color and the players alternate turns in knocking down a domino under one's control. Because of the placement of dominoes, one or more dominoes may be toppled by a single move by a player. The first player forced to knock down all of the dominoes under his/her control loses the game. To combine entertainment with the strategy, a configuration of other board types is associated with the special board.

6 Claims, 5 Drawing Sheets

QUICK-SET DOMINO ARRANGEMENTS INCLUDING TWO-PERSON DOMINO CHALLENGE GAME

FIELD OF THE INVENTION

This invention relates generally to utilization of dominoes for entertaining education and, more particularly, to mechanical arrangements for quickly setting dominoes vertically in place for chain reaction-type tumbling, such arrangements including a two-person game of strategy.

BACKGROUND OF THE INVENTION

The entertainment aspect of viewing dominoes, first initially arranged in an upright position in a unique and/or complex pattern such as a "figure eight", and then the sequential tumbling action as a randomly selected domino is set into motion is readily appreciated. There is a certain anticipation, even fascination, in observing the dominoes tumble in a progressive, rhythmical manner. However, the fun of watching dominoes tumble is always preceded by the tedious task of setting the dominoes precisely into place. This is usually completed manually and the alignment is effected by measuring the exact spacing between dominoes or by deploying an underlying pattern having locations marked for the accurate placement of the dominoes. Oftentimes tens of minutes, or even hours for complex designs, are required to complete a set-up.

The prior art has contemplated semi-automatic devices for setting dominoes into place, but these devices must be manually loaded with the dominoes. Accordingly, the process is still time consuming and the layouts created are somewhat limited.

Conventional toppling domino arrangements have concentrated completely on the entertainment aspect. No challenge aspect, such as a game involving two players pitted in strategy against each other, has been offered in the art. There presently does not exist a domino board game which combines the entertainment aspect of falling dominoes with the strategic aspect of selecting which domino in an array of dominoes is the critical one to topple to accomplish a given outcome. One such outcome would be to designate as the game winner the last player to have at least one domino standing after the other player has been forced to knock down all of the dominoes in his/her control. Also, to the best of my knowledge, no domino game arrangement has a theoretical foundation based on an esoteric branch of advanced mathematics called "game theory". The creation of a board game arrangement having a "game theory" foundation is a non-trivial and such an arrangement would provided a quantum degree of sophistication to the art of domino arrangements.

SUMMARY OF THE INVENTION

These shortcomings and limitations are obviated, in accordance with the present invention, by rotatably mounting an array of dominoes on the top surface of a game board so that the array may be quickly reset by a single manipulation of a user/player. By introducing various game board shapes, such as rectangular, hexagonal and trapezoidal, and interconnecting a plurality of boards to form a combined array having numerous dominoes, the knocking over of a single domino by the player causes all remaining dominoes to tumble in chain-reaction manner. Configurations of interconnected boards include an oval and a "figure eight". To reset the boards of a configuration, only some of the boards must be decoupled into smaller sub-configurations called modules, and all of the dominoes on each module may be set by a single manipulative action.

The game aspect of the invention is effected by arranging an array of two-color dominoes on a trapezoidally shaped board according to a mathematical algorithm, and introducing a set of rules to play the game. There are two players that alternate turns. Each player is given a domino color to control. For each player's turn, the player must knock down one of the dominoes he/she controls. Because of the arrangement of dominoes, one or more dominoes of either color may be toppled by this player's move. In one version of the game, the first player forced into a position of knocking down all of the dominoes in his/her control because of strategic moves of the other player loses the game.

The organization and operation of this invention will be better understood from a consideration of the detailed description of the illustrative embodiments thereof, which follow, when taken in conjunction with the accompanying drawing.

DETAILED DESCRIPTION

Figure 1:
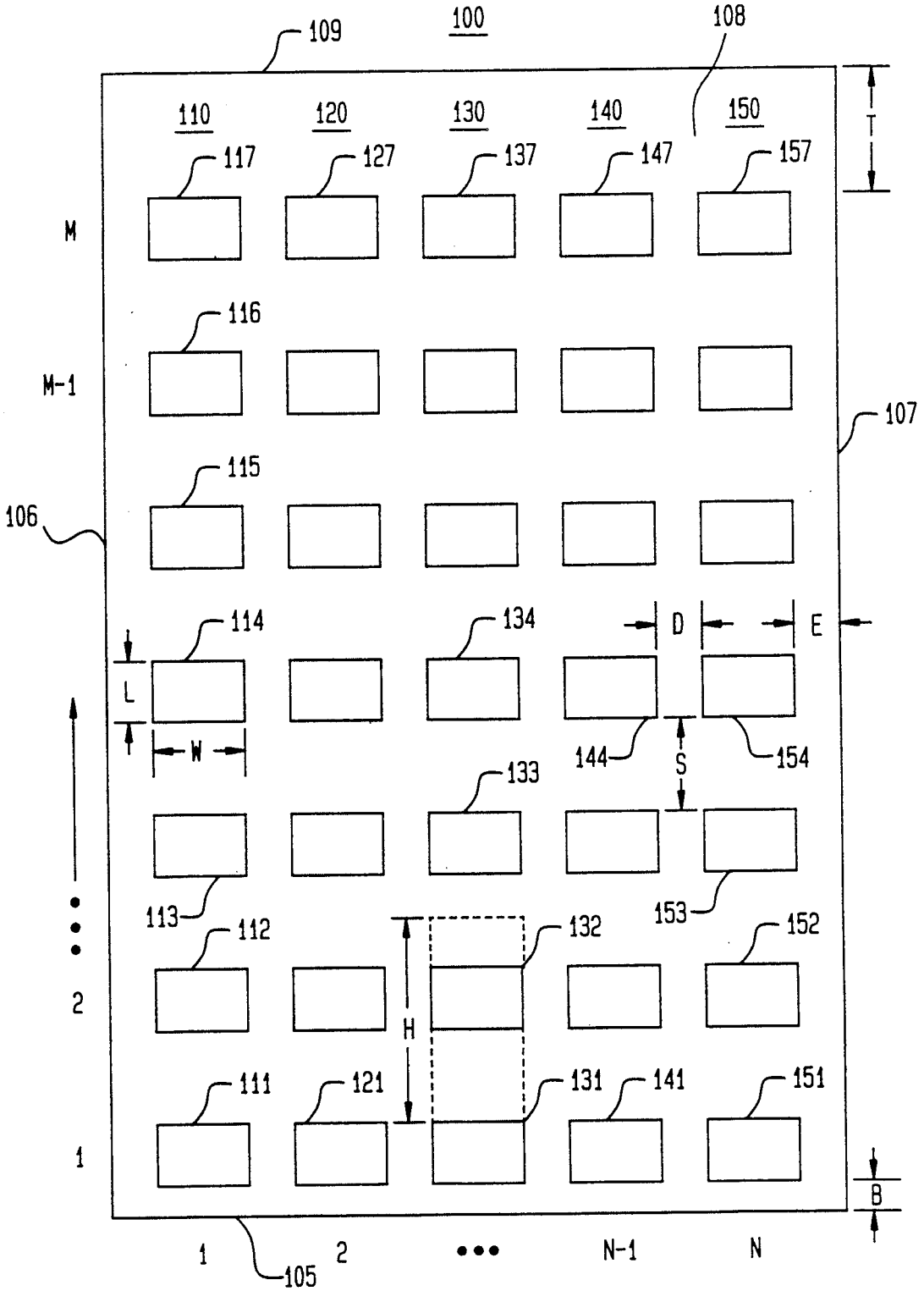
FIG. 1 illustrates, in top view, the arrangement of dominoes in and M×N array on the top surface of the rectangular game board in accordance with the present invention.

With reference to FIG. 1, rectangular board 100 is shown in top view. Rotatably mounted on top surface 108 of board 100 are a plurality of dominoes 111–117, 121–127, . . . , 151–157 arranged in, generally, an array of M rows and N columns; here, M=7 and N=5. If general row and column identifiers are given by i and j, respectively, then any domino in the array is uniquely identified by its (i, j) pair. In this notation, i ranges from 1 to M and j ranges from 1 to N.

In accordance with the illustrative embodiment, board 100 has overall rectangular dimensions of 50 unites row-wise and 65 units column-wise. This allows for the strategic placement of the dominoes for chain-reaction tumbling according to the following scheme. Each domino has a length (L) of 6 units, a width (W) of 3 units and a height (H) of 12 units. The L and W dimensions are shown for domino 114. The H dimension is shown for domino 131 by the dashed rectangle overlaying domino 132. All dominos shown by the solid 3-by-6 unit rectangles are assumed to be in the transverse or upright position relative to top surface 108. The dashed rectangle is representative of the position of domino 131 when it is in its lateral or tumbled position relative to top surface 108. The tumbled position of a given domino is the at-rest position of the domino once it has been knocked over and it is resting on the base of the adjacent domino which is also in the tumbled position. This position is variously spoken of as being the lateral position or the prone position as well, although if there is no adjacent domino in the direction of tumbling, then the tumbled, lateral or prone position is basically the horizontal position on the top surface of the board.

Each domino is separated by 6 unites (e.g., the S dimension between dominoes 153 and 154) in the column direction and by 4 units (e.g., the D dimension between dominoes 144 and 154) in the row direction. The left-most column 110 and the right-most column 150 are 2 units (e.g., the E dimension of domino 154) from edges 106 and 107, respectively, of board 100. The lower row of dominoes 111, 121, . . . , 151 is 2 units (e.g., the B dimension of domino 151) from lower edge 105 of board 100, whereas the upper row of dominoes 117, 127, . . . , 157 is 6 units (e.g., the T dimension of domino 157) from upper edge 109 of board 100.

The dominoes are arranged to tumble in the direction shown by the arrow next to left edge 106 of the board, that is, in the direction from lower board edge 105 to upper board edge 109. In terms of a specific column, say column 110, dominoes 111–117 are arranged so that, if domino 111 is pushed into motion by a player, it rotatably tumbles in the direction of domino 112. Domino 111 then strikes domino 112, causing domino 112 to also rotatably tumble in the direction of domino 113. This chain reaction continues in a sequential manner until all dominoes in column 110 are in their tumbled position. In general, for the $j^{th}$ column, if the $i^{th}$ domino is nudged into a tumbling motion, then all dominoes i+1, i+2, . . . , M also tumble in a chain-reaction fashion.

Because of the placement of row M relative to upper board edge 109, any domino in row M overhangs upper board edge 109 by 6 units in its prone position. This means that another domino board placed to abut upper board edge 109 may also have its dominoes set into motion by the tumbling action of the dominoes on board 108. Similarly, yet another domino board placed to abut lower board edge 105 may cause the dominoes on board 108 to fall in sequential order in each column by tumbling action set into motion on the abutting board.

Figure 2:
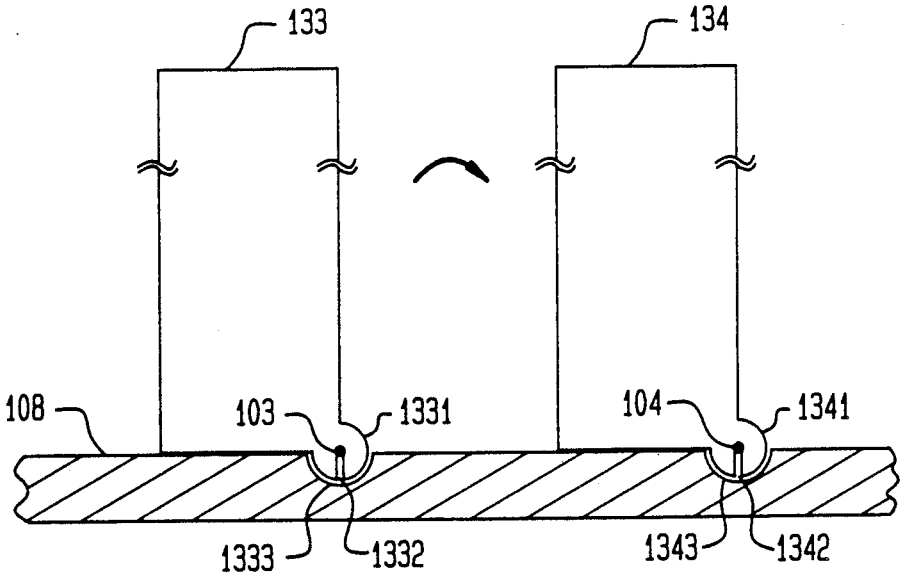
FIG. 2 shows, in a cross-sectional, partial side view, one illustrative arrangement for rotatably mounting the dominoes to the top surface of the board depicted in FIG. 1.

Now, with reference to FIG. 2, there is shown one technique for rotatably mounting the dominoes of FIG. 1 to top surface 108. In particular, FIG. 2 depicts, in a cross-sectional, partial side view, two representative dominoes 133 and 134 adapted for mounting to axles 103 and 104, respectively. Axles 103 and 104 are arranged in a direction transverse to the direction of tumbling and extend from left-hand edge 106 to right-hand edge 107 of board 100 of FIG. 1 across all columns 110–150 associated with rows i=3 and i=4, respectively. Axles 103 and 104 may be fixedly mounted to board edges 106 and 107 in any standard manner. Semicircular indentations 1333 and 1343, associated with the $3^{rd}$ and $4^{th}$ rows, are formed in top surface 108 and are aligned with axles 103 and 104, respectively, in the transverse direction. Dominoes 133 and 134 are formed with circularly-shaped hubs 1331 and 1341, respectively, in their lower right corners; these hubs cooperatively mate with indentations 1333 and 1343, respectively. Slits 1332 and 1342 formed in hubs 1331 and 1341, respectively, allow for dominoes 133 and 134 to be forcibly inserted onto axles 103 and 104. As arranged, dominoes 133 and 134 fall or tumble in the clockwise direction in FIG. 2, as shown by the arrow between dominoes 133 and 134. All other rows not shown in FIG. 2 are similarly arranged with axles, indentations, hubs and slits.

Figure 3:
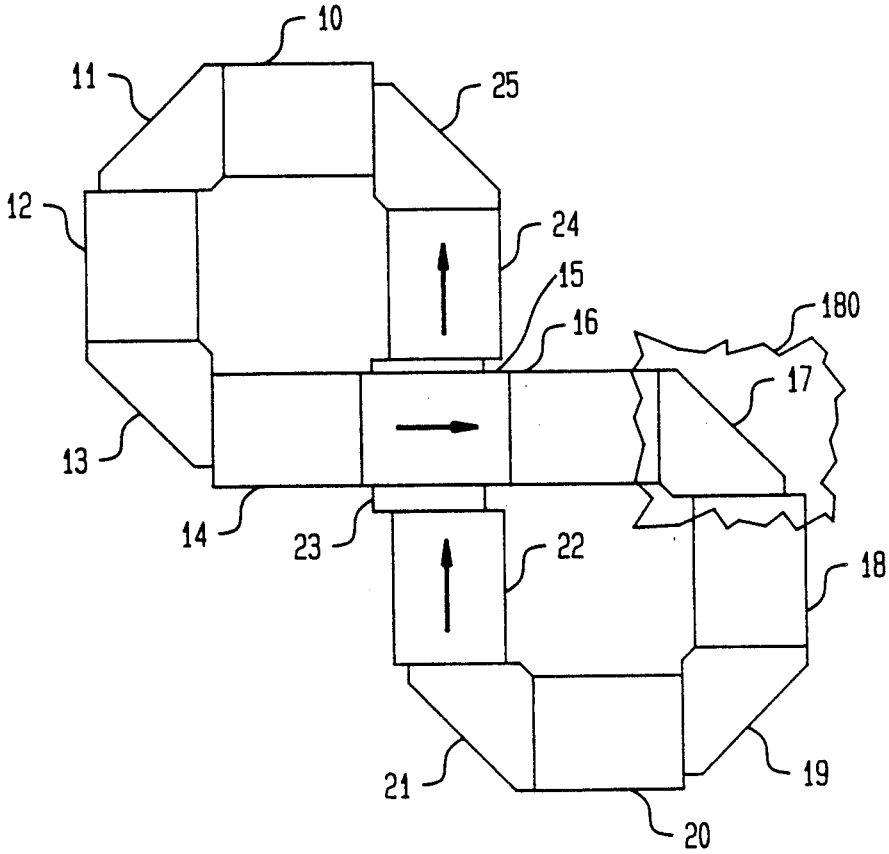
FIG. 3 depicts the so-called "figure eight" layout of rectangular and hexagonal game boards arranged so that the tumbling of any domino in the arrangement causes all of the remaining dominoes to tumble in a chain-reaction type manner.
Figure 4:
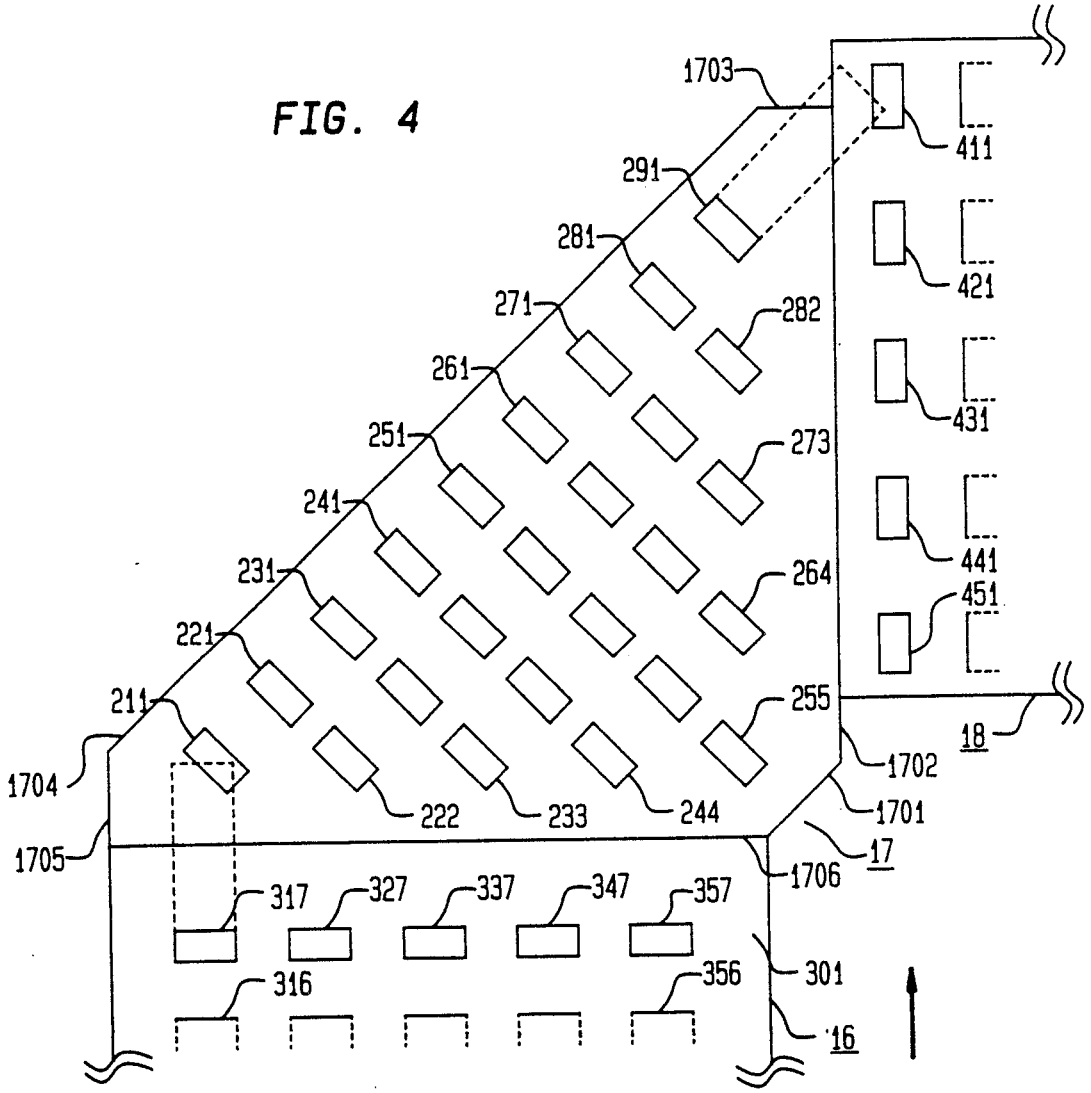
FIG. 4 illustrates, in top view, a portion of the "figure eight" layout of FIG. 3 showing the arrangement of dominoes on the hexagonal board, and the relative orientation of dominoes on the two adjacent rectangular boards abutting the the hexagonal board to the dominoes on the hexagonal board to effect continuous tumbling action.

Referring now to FIG. 3, a so-called "figure-eight" layout of rectangular and hexagonal boards is shown. The rectangular boards are labeled 10, 12, 14–16, 18, 20, and 22–24 starting from the top and proceeding in the direction of tumbling shown by the arrow on boards 15, 22 and 24. The hexagonal boards are designated by labels 11, 13, 17, 19, 21 and 25. As discussed shortly, the boards at the cross-over point of the "figure eight" are arranged in bridge-like fashion to effect non-interfering tumbling. To further understand the arrangement of boards in FIG. 3, it is instructive to first focus on a portion of the "figure eight" layout, as shown by reference numeral 180 in FIG. 3; FIG. 4 shows this sub-layout.

In FIG. 4, hexagonal board 17 is shown with its two associated rectangular boards 16 and 18 abutting bottom edge 1706 and right-hand edge 1702, respectively. To described the shape of board 17, the perimeter edge dimensions as well as the angles of adjacent edges are given in counterclockwise direction starting with edge 1701. For example, edge 1701 is $5\sqrt{2}$ units in length, edge 1702 is 50 units in length and they meet at an angle of 135 degrees. This edge-corner edge relation may be summarized by the notation $<5\sqrt{2},135,50>$. Using this notation, the complete hexagonal shape has the following description: $<5\sqrt{2},135,50,90,5,135,50\sqrt{2},135,5,90,50,135>$. In this notation, edge lengths and angles alternate, starting with an edge length and ending with an angle. The dominoes populating board 17 are arranged in an array of five columns having nine, seven, five, three and one dominoes, respectively. The column of nine dominoes 211, 221, . . . , 291 is placed adjacent edge 1704 such that each domino 211, . . . , 291 is one unit from edge 1704. Each domino in this column of nine dominoes is placed 6 units from each other in the direction of rotation similar to a rectangular board; thus, for example, domino 241 is 6 units from both dominoes 231 and 251. Besides being aligned in columns, the dominoes are also arranged in row manner. For instance, the so-called center row, which comprises dominoes 251–255, is aligned along an axis which bisects both edges 1701 and 1704. The dominoes on his row are separated by 2 units. The other eight rows, namely, those rows having lead dominoes 211–241 and 261–291, are arranged parallel to this reference axis and are 6 units apart. Also, multiple dominoes along these rows are again 2 units apart.

With this general layout in focus, it is now possible to described how abutting boards 16 and 18 are arranged to effect continuous tumbling action from board 16 through board 17 to board 18. Edge 1706 of board 17 is basically aligned with the top edge of board 16 so that, for example, domino 317 of board 16, whenever it tumbles, knocks over domino 211 of board 17. This, in turn, causes s sequential tumbling of all dominoes in the column adjacent to edge 1704 on board 17, namely dominoes 211, 221, . . . , 291. Ultimately, domino 291 strikes domino 411 on board 18, thereby causing all dominoes in the column headed by domino 411 to tumble on board 18. Dominoes 317 and 291 are shown in their prone positions by dashed lines. In order that domino 291 strikes domino 411 and only domino 411, it is necessary to offset board 18 relative to edge 1702 of board 17; this offset is shown as 5 units in FIG. 4.

With this local view of boards 16–18 complete, the layout of FIG. 3 may be more fully described. A multiplicity of domino boards may be grouped into a so-called module with an appropriate locking mechanism (discussed shortly with reference to FIG. 6). For example, boards in the arrangement of FIG. 3 may be interlocked in four modules: 10–12, 13–17, 18–20, and 21–25. All dominoes with a module must have a similar direction of tumbling. Similarity of direction means that all dominoes lie within a range of 90 degrees relative to each other. With this requirement, all dominoes comprising a module may be reset or erected with a single manipulative motion by the force of gravity. (In theory, it is possible to erect all dominoes of a module in one single motion as long as the directions of all dominoes are within any range up to 180 degrees; however, restricting the range to 90 degrees greatly facilitates the resetting of the dominoes). Also, the user may rearrange the manner in which boards are grouped into modules at any time as long as the resetting angle constraint is satisfied. Consistent with this rearrangement, the modules may be linked in somewhat arbitrary fashion such as in an oval or a circle; the "figure eight" represents but one type of play.

To demonstrate the tumbling action that may be effected with the "figure eight", it is supposed that domino 317 of board 16 (see FIG. 4) is set in motion by the player. Then all dominoes in the column-of-nine on board 17 tumble in succession. Next, all dominoes in the column having domino 411 as the lead domino fall in sequential order. A falling sequence similar to board 17 now occurs across board 19. In turn, a tumbling sequence similar to board 16 occurs across board 20. Next, the tumbling sequence across board 21 corresponds to that across boards 17 and 19. Board 22 takes on the same tumbling sequence as boards 18 and 20. However, a change of sequence occurs for board 23 because of the alignment of board 23 relative to board 22. It is noted that, instead of being exactly aligned, these two boards are offset by 5 units. This causes the last domino in the left-hand column of board 22 (which corresponds to domino 117 in column 110 of FIG. 1) to strike two dominoes simultaneously on board 23 (which correspond to dominoes 111 and 121 in columns 110 and 120 of FIG. 1). As the tumbling traverses board 23, the two left-most columns on board 23 strike two columns on board 24 (which corresponds to columns 110 and 120 of FIG. 1). Now, two columns of dominoes tumble in chain-reaction fashion across boards 25 and 10–15. One of those rows stops tumbling when the tumbling action reaches domino 317 of board 16; recall this is the domino set in motion by the player to initiate the tumbling so it is already prone. However, the second tumbling column continues across board 16, eventually reaching domino 327 which, in turn, strikes domino 222 of board 17. This initiates another complete traverse around the "figure eight" which may be described in substantially the same manner as above. Ultimately, all 500 hundred dominoes are tumbled.

Figure 5:
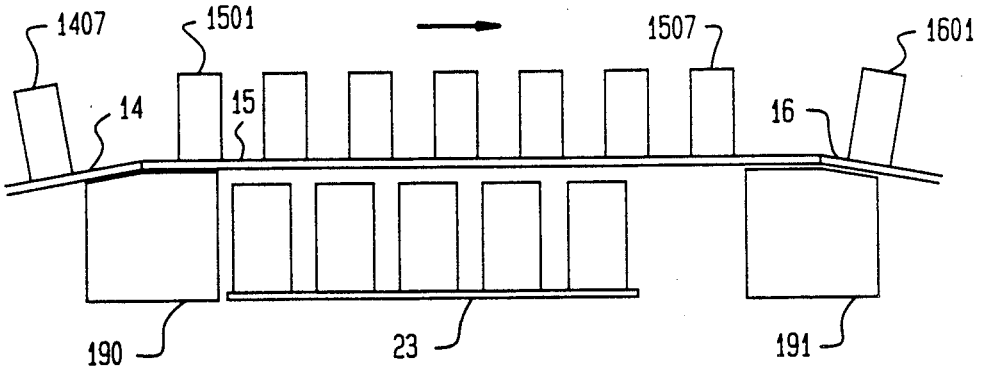
FIG. 5 illustrates, in a side view, the bridge arrangement at the cross-over point of the "figure eight", including the supports necessary to implement the bridge arrangement structure.

It must be pointed out that the above description of the tumbling action did not indicate how the cross-over at the center of the "figure eight" was traversed. The arrangement of FIG. 5 depicts how the cross-over point may be traversed. Shown in FIG. 5, in side view fashion, is the arrangement of boards 14–16 and 23 to provide a raised cross-over point. Boards 14–16 are raised, in bridge-like fashion, over board 23. Supports 190 and 191 maintains the left-hand and right-hand ends of board 15 in place with sufficient clearance above the dominoes of board 23. Supports 190 and 191 also have a sloped portion on their top surface to allow for boards 14 and 16, respectively, to slope to and join with the boards abutting boards 14 and 16 at the same level as board 23 (that is, boards 13 and 17). The slope is chosen so that the dominoes on boards 14 and 16 will remain upright until knocked over even though the boards themselves have a slight tilt. As shown in FIG. 5, this slope is in the ratio of about 1:5. With this slope and the dimensions of each domino, the center of gravity of a domino remains within the base area of the domino as it rests on the sloping board, thereby maintaining the tilting dominoes in their upright position.

Figure 6:
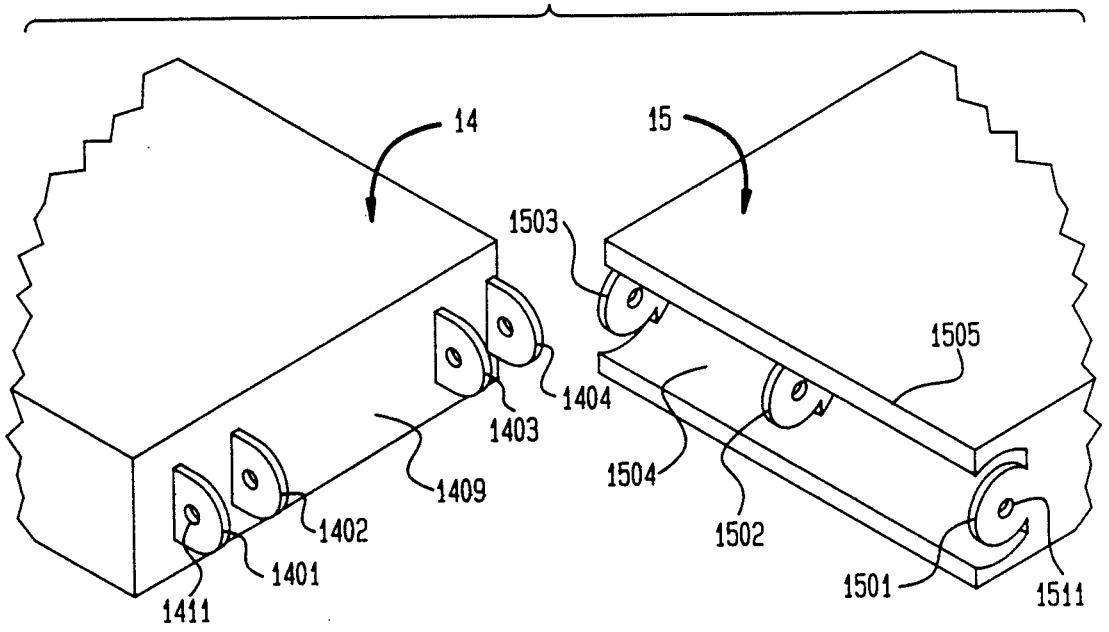
FIG. 6 depicts one mechanical arrangement for linking boards to form the interconnected arrangements of the present invention.

With reference to FIG. 6, one mechanical arrangement for linking boards together to form modules and, in turn, plays, is depicted utilizing boards 14 and 15 as exemplary boards. In the left-hand portion of FIG. 6, a right perspective view of board edge 1409 of board 14 (which corresponds to edge 109 in FIG. 1), is shown. As depicted, a plurality of semi-circular nubs 1401–1404 are arranged in protruding relation from edge 1409. Each nub 1401–1404 has an aperture so that all apertures are aligned in transverse relation across edge 1409; an exemplary aperture 1411 is shown cut through nub 1401. The apertures are adapted to receive a linking rod (not shown), as discussed in more detail shortly. The number and location of nubs 1401–1404 are selected according to the anticipated offset used to link boards into modules and plays.

In the right-hand portion of FIG. 6, a left perspective view of board edge 1505 of board 15 (which corresponds to edge 105 in FIG. 1), is shown. As illustrated, semi-circular indentation 1504 is cut lengthwise in edge 1505. This indentation is cooperatively aligned to mate with hubs 1401–1404 of board 14. Formed along edge 1505, within indentation 1504, are nodules 1501–1503. These nodules are also arranged with apertures which are aligned in transverse relation across edge 1505; aperture 1511 in nodule 1501 is representative. The nodules and apertures are adapted to receive the same linking rod (not shown) inserted through nubs 1401–1404 of board 14. To link boards 14 and 15, nub edge 1409 is inserted into indentation edge 105 and the linking rod is then slipped through all aligned apertures; in this illustrative case, there are seven aligned apertures. With this manner of connection, boards 14 and 15 are linked in rotatable fashion to facilitate resetting the dominoes.

Game

To this point in the description, the one-player entertainment aspect of the present invention has been discussed. To add an element of strategy to the entertainment aspect, a two player game of challenge utilizing dominoes as the game pieces may also be devised and the game may be played either on a stand-alone basis or in conjunction with the board-types already presented. The game is laid out on a trapezoidal board, which is depicted in pictorial fashion in FIG. 7 for the stand-alone game.

Figure 7:
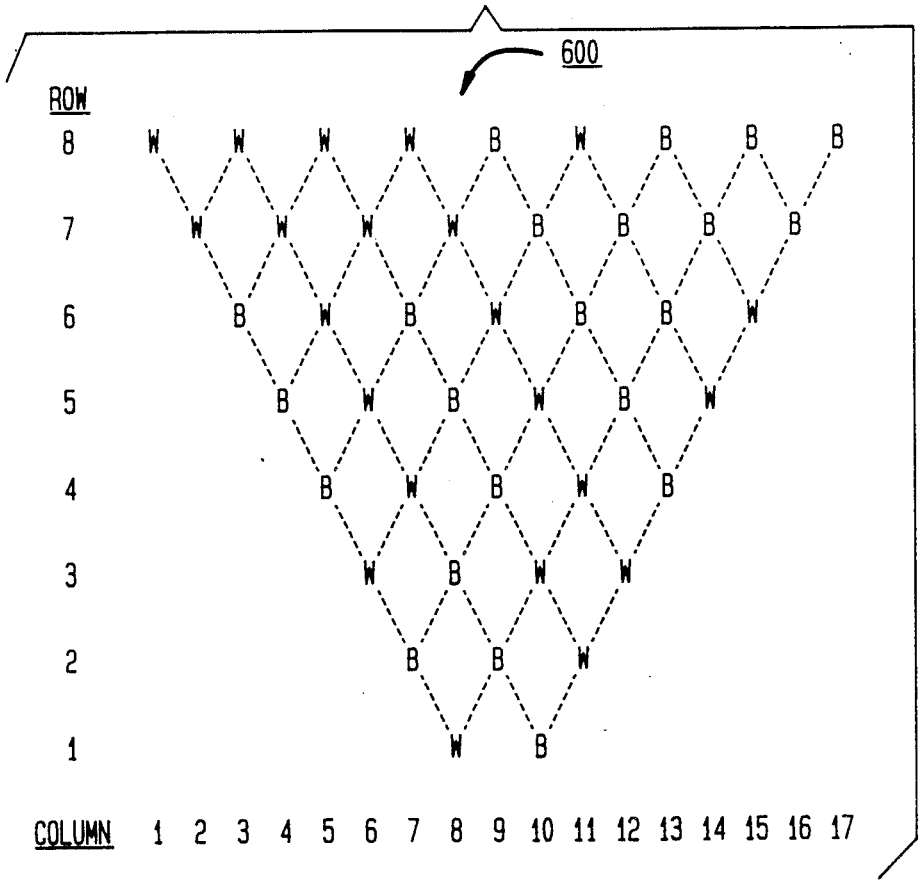
FIG. 7 is a pictorial representation, using black (B) and white (W) dominoes, to show the layout of the trapezoidal board in accordance with the two-player challenge aspect of the present invention.

With reference to FIG. 7, domino array 600 is shown arranged in eight rows 1–8 and columns 1–17. The dominoes in array 600 are rotatably mounted to trapezoidal board 601 (see FIG. 8) in the same fashion and with basically the same rationale of spacing as presented earlier with respect to rectangular board 100 and/or hexagonal board 17. The first row has two dominoes, a white (W) one adjacent a black (B) one. The second row has three dominoes, namely, two B's and a W. The first and second rows are arranged relative to one another in criss-cross fashion, that is, the two B's of the second row straddle the W of the first row, whereas the middle B and the W of the second row straddle the B of the first row. In other words, if the two dominos of row 1 are in positioned in columns 8 and 10, then the three dominoes of row 2 are positioned in columns 7, 9 and 11, respectively. With this layout, the W in the first row knocks over only the two B's in the second row. Similarly, the B in the first row would strike the middle B and the W of the second row. This criss-cross association is shown in FIG. 7 by the dashed lines interconnecting the dominoes in the full array.

This criss-cross, straddle relationship of dominoes is maintained throughout the array of FIG. 7. For instance, the sixth row comprises the following sequence of dominoes: B, W, B, W, B, B, W; also, the seventh row comprises the sequence: W, W, W, W, B, B, B, B. Then, for example, with this layout, the first B of the sixth row tumbles the first and second W of the seventh row, that is, the domino in column 3 of the row 6 knocks over both the dominoes in columns 2 and 4 in row 7.

In the complete trapezoidal array, there are twenty-two W and twenty-two B dominoes. One player of the game owns or controls the B dominoes and the other player controls the W dominoes. Each player alternates turns in pushing down dominoes. At each turn, a layer must push down a domino in the color he/she controls. The domino pushed down at each turn may be any upright domino of the controlled color in the array. Because of the criss-cross arrangement of dominoes, the domino pushed by the player may cause other dominoes in either W or B or both colors to tumble in chain reaction fashion. The loser of the game is the first player to knock over all the dominoes he/she controls.

The strategy of the game is based upon an esoteric branch of mathematics called "game theory." In particular, this two-person domino game is an application of the "Zugzwang" game theory, which is a complete theory on a class of two-person, perfect-information games. The word "Zugzwang" means the phenomenon when a chess player is faced with a move but would prefer to pass the move because all allowed moves lead to a less advantageous position. A "Zugzwang" game is defined as one in which it is always to one's disadvantage to move. The location of the B and W pieces on board 600 in FIG. 7 have been determined by satisfying specific mathematical relations in the "Zugzwang" theory to essentially balance the chance of winning by either player.

Figure 8:
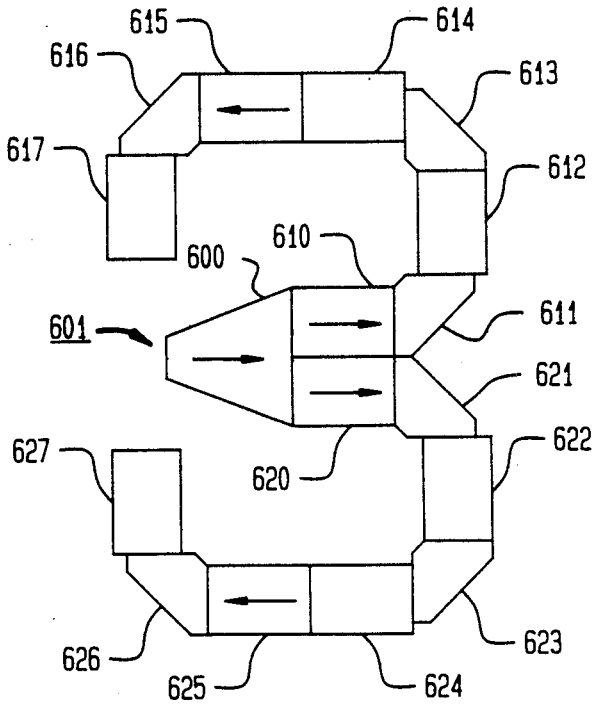
FIG. 8 illustrates the so-called "figure three" layout of rectangular, hexagonal and trapezoidal game boards combining the challenge aspect with the entertainment aspect of the present invention.

An expanded version of the game is to associate the trapezoidal board 601 having array 600 mounted thereto with the rectangular and hexagonal boards previously described. This combination of three board types increases the entertainment aspect of the game since more dominoes fall in the chain-reaction manner. One possible arrangement is shown in FIG. 8, which is the so-called "figure three" setup. As depicted, one set of modules comprising boards 610–617 is associated with the upper half of board 600. A similar arrangement of modules composed of boards 620–627 is associated with the lower half of board 600. The tumbling directions for the various boards are shown by the arrows. The manner of connecting the modules and the tumbling action anticipated may be readily deduced from the foregoing description. The rectangular and hexagonal boards are mounted with neutral color dominoes (ay color different than B and W) except for randomly interspersed B or W dominoes, typically at the rate of one per board. To make each player's change of winning almost the same, there are equally many B and W dominoes so interspersed on these boards. With this implementation, the players have the option of pushing down any domino within their control, including dominoes on the rectangular and hexagonal boards. Since the change of winning the game on the trapezoidal board alone is well balanced, the arrangement of rectangular and hexagonal boards in the "figure three" formation can tilt the balance in either direction. In setting up the game, a sophisticated player would be able to select a permutation of rectangular and hexagonal boards to provide himself/herself an advantage.

In a variation on the game rule, the winner is the player who is first to push down his/her controlled dominoes. With this opposite rule of winning, the game is no longer a "Zugzwang" game and it is always to one's advantage to move. The trapezoidal board is not suitable for this variation.

It is to be further understood that the arrangements of game boards, including the arrays of dominoes rotatably mounted on the boards, described herein are not limited to specific forms by way of illustration, but may assume other embodiments limited only by the scope of the appended claims.

What is claimed is:

1. A toppling domino game device comprising a game board, an array of dominoes arranged in predetermined rows and columns on said board such that said dominoes are cooperatively juxtaposed as follows:

(a) each of said dominoes is rotatably mounted to the top surface of said board to effect rotational movement between an upright position substantially perpendicular to said surface and a basically prone position relative to said top surface;

(b) with said dominoes in said upright position, each column is configured so that when an arbitrary one of said dominoes in said column is set in motion by a player, all other dominoes in said each column in the direction of said rotational movement tumble sequentially to said prone position; and (c) said array is further adapted to set said dominoes to said upright position by sequential movement of said board by the player from a horizontal orientation to a substantially vertical orientation and then back to said horizontal orientation, wherein said board is a hexagonally-shaped, thin planar board, said array of dominoes is arranged in M rows (i=1, 2, . . . , M) and N columns (j=1, 2, . . . , N) such that the j=1 column has M dominoes, M odd, the j=2 column has M−2 dominoes, and so forth, and with said each column identified as the $j^{th}$ column, and with said arbitrary one of said dominoes equated to the $i^{th}$ domino, then all dominoes i+1, i+2, . . . , in said $j^{th}$ column tumble to said prone position.

2. A toppling domino game device comprising a game board, an array of dominoes arranged in predetermined rows and columns on said board such that said dominoes are cooperatively juxtaposed as follows:

(a) each of said dominoes is rotatably mounted to the top surface of said board to effect rotational movement between an upright position substantially perpendicular to said surface and a basically prone position relative to said top surface;

(b) with said dominoes in said upright position, each column is configured so that when an arbitrary one of said dominoes in said column is set in motion by a player, all other dominoes in said each column in the direction of said rotational movement tumble sequentially to said prone position; and (c) said array is further adapted to set said dominoes to said upright position by sequential movement of said board by the player from a horizontal orientation to a substantially vertical orientation and then back to said horizontal orientation, wherein said board is a trapezoidally-shaped thin planar board said array of dominoes is arranged in M rows (i=1, 2, . . . , M) and N columns (j=1, 2, . . . , N), N odd, such that: the i=1 row has two dominoes, the i=2 row has 3 dominoes, . . . , and the $i^{th}$ row has i+1 dominoes; the two dominoes of the i=1 row are positioned in the (N−1)/2 and (N−1/2+2 columns, respectively, the three dominoes of the i=2 row are positioned in the (N−1)/2−1, (N−1)/2+1 and (N−2)/2+3 columns, respectively, and so forth such that the dominoes of the $i^{th}$ row occupy column locations which alternate with the dominoes of the i+1)$^{th}$ row; said array being arranged such that when the arbitrary domino set in motion is in the $i^{th}$ row and the $j^{th}$ column, then the dominoes in the i+1 row and the j−1 and j+1 columns tumble to said prone position as well as the dominoes in the i+2 row and the j−2, j, and j+2 columns, and so forth in said sequential manner.

3. A toppling domino game device comprising a trapezoidally-shaped thin planar board, an array of dominoes arranged in predetermined M rows (i=1, 2, . . . , M) and N columns (j=1, 2, . . . , N), N odd, such that: the i=1 row has two dominoes, the i=2 row has 3 dominoes, . . . , and the $i^{th}$ row has i+1 dominoes; the two dominoes of the i=1 row are positioned in the (N−1)/2 and (N−1)/2+2 columns, respectively, the three dominoes of the i=2 row are positioned in the (N−1)/2−1, (N−1)/2+1 and (N−2)/2+3 columns, respectively, and so forth such that the dominoes of the $i^{th}$ row occupy column locations which alternate with the dominoes of the (i+1)$^{th}$ row; said array being arranged such that when an arbitrary domino is set in motion by a player in the $i^{th}$ row and the $j^{th}$ column, then the dominoes in the i+1 row and the j−1 and j+1 columns tumble as well as the dominoes in the i+2 row and the j−2, j, and j+2 columns, and so forth in said sequential manner, and wherein each domino is assigned one of two preselected identifiers and all of said dominoes are arranged in a predetermined manner on said board.

4. The device as recited in claim 3 wherein one of said identifiers is a first color designated B and the other of said identifiers is a second color designated W, and said rows and columns are arranged as follows:

i=1 has dominoes of colors W and B in columns 8 and 10, respectively;

i=2 has dominoes of colors B, B, W in columns 7, 9, 11, respectively;

i=3 has dominoes of colors W, B, W, W in columns 6, 8, 10, 12, respectively;

i=4 has dominoes of colors B, W, B, W, B in columns 5, 7, 9, 11, 13, respectively;

i=5 has dominoes of colors B, W, B, W, B, W in columns 4, 6, 8, 10, 12, 14, respectively;

i=6 has dominoes of colors B, W, B, W, B, B, W in columns 3, 5, 7, 9, 11, 13, 15, respectively;

i=7 has dominoes of colors W, W, W, W, B, B, B, B in columns 2, 4, 6, 8, 10, 12, 14, 16, respectively; and i=8 has dominoes of colors W, W, W, W, B, W, B, B, B in columns 1, 3, 5, 7, 8, 11, 13, 15, 17, respectively.

5. The device of claim 3 further comprising a configuration composed of a plurality of game boards with each said game board having an array of dominoes arranged in rows and columns, and wherein (a) each of said dominoes is rotatably mounted to the top surface of said board to effect rotational movement between an upright position substantially perpendicular to said surface and a basically prone position relative to said top surface;

(b) with said dominoes in said upright position, each column is configured so that when an arbitrary one of said dominoes in said column is set in motion by a player, all other dominoes in said each column in the direction of said rotational movement tumble sequentially to said prone position; and (c) said array is further adapted to set said dominoes to said upright position by sequential movement of said board by the player from a horizontal orientation to a substantially vertical orientation and then back to said horizontal orientation, and wherein said configuration is interconnected to said trapezoidally-shaped board so that when an arbitrary domino on any of said boards is set in motion by the player, a plurality of dominoes in a path of rotational movement tumble sequentially to said prone position.

6. The device as recited in claim 5 wherein said boards of said configuration each has a randomly located domino having one of said identifiers randomly selected.

* * * * *